US007234894B1

(12) United States Patent
Flury

(10) Patent No.: US 7,234,894 B1
(45) Date of Patent: Jun. 26, 2007

(54) STORM DRAIN BASIN GATE SYSTEM

(76) Inventor: Ronald J. Flury, 19500 Normandie Ave., Torrance, CA (US) 90502

( * ) Notice: Subject to any disclaimer, the term of this patent is extended or adjusted under 35 U.S.C. 154(b) by 0 days.

(21) Appl. No.: 11/335,591

(22) Filed: Jan. 20, 2006

(51) Int. Cl.
*E03F 5/06* (2006.01)
*E02B 7/40* (2006.01)

(52) U.S. Cl. ..... 405/94; 404/4; 210/131; 210/156; 210/163; 405/101

(58) Field of Classification Search ..... 405/87, 405/90, 92, 93, 94, 99, 100, 101; 210/163, 210/131, 156; 404/4
See application file for complete search history.

(56) References Cited

U.S. PATENT DOCUMENTS

| | | | | |
|---|---|---|---|---|
| 440,067 | A * | 11/1890 | Smith | 210/163 |
| 1,143,496 | A | 6/1915 | Briles | 210/156 |
| 1,220,123 | A | 3/1917 | Heybach | 210/136 |
| 1,245,903 | A | 11/1917 | Gross | 210/163 |
| 2,198,943 | A | 4/1940 | Lowe | 210/162 |
| 4,418,432 | A | 12/1983 | Vidal | 4/286 |
| 4,935,129 | A | 6/1990 | Wang | 210/131 |
| 5,788,849 | A | 8/1998 | Hutter, Jr. et al. | 210/163 |
| 6,015,489 | A | 1/2000 | Allen et al. | 210/131 |
| 6,217,756 | B1 | 4/2001 | Martinez | 210/163 |
| 6,733,665 | B1 | 5/2004 | Khalil | 210/122 |
| 6,821,053 | B2 | 11/2004 | Martinez | 405/40 |
| 6,972,088 | B2 | 12/2005 | Yehuda | 210/156 |
| 2004/0069697 | A1* | 4/2004 | Martinez | 210/163 |
| 2004/0173513 | A1 | 9/2004 | Nino | 210/156 |

* cited by examiner

*Primary Examiner*—Tara L. Mayo
(74) *Attorney, Agent, or Firm*—Jones Day

(57) ABSTRACT

An automatically openable and closeable gate system that will find primary use with the street curb opening to a catch basin or vault of a storm drain system, and for other similar openings, the system having a gate which during dry and low-flow water drainage situations will be in a closed position such that items of trash, debris, litter, leaves and the like will be prevented from entering the basin, vault or system, yet in periods of heavy rainfall or other heavy water run-off situations will automatically open to allow free flow of water into the basis or vault to alleviate water accumulation in the adjacent street and other surrounding areas.

5 Claims, 1 Drawing Sheet

STORM DRAIN BASIN GATE SYSTEM

BACKGROUND OF THE INVENTION

This invention relates generally to a gate system for use with a storm drain of the type typically found in the curb of a street. More particularly, this invention relates to such a system which during periods of low water flow is in a closed position to effectively prevent debris from entering into the storm drain, but which during periods of high water flow opens to allow the maximum amount of water to enter into the drain to alleviate the accumulation of water in the street and the surrounding areas.

What to do with excess runoff rain water has been an issue for urban planners and dwellers for a long time. Even in arid regions, the occasional heavy rainfall will create large volumes of run off that must be channeled effectively or flooding resulting in impassable roads at least or the loss of property and lives at worst may occur. In areas of high annual rainfall, effectively channeling that rainwater away from streets and homes is an absolute must For this reason, almost every city in the civilized world has an extensive underground storm drain system. And the most common inlet to the entire system is the ubiquitous curbside opening that is built into the sidewalk curb along the street. Those openings typically lead to a rather large underground chamber, often called a vault, at one end of which there is a conduit that leads to the main storm drain pipe that is usually set under the paved road adjacent the vault.

These drain systems have proven very effective in channeling runoff storm water away from the streets and populated areas, and usually into an adjacent river or into the ocean. However, another ubiquitous part of urban life—street debris and litter—also finds its way into the storm drain system. For example, some cigarette smokers seem to believe that their cigarette butts are not litter to be deposited in a trash can, but something that can be thrown on the ground wherever they happen to be when they must discard the cigarette—thrown into the gutter as they walk along the sidewalk, or thrown out of the car as they drive along. These cigarette butts, which are not environmentally friendly and do not naturally degrade easily, invariably end up in the drain system and then into the river or ocean into which it drains. Other trash, from paper cups to hamburger wrappers to envelops, all find there way into the gutters, drain systems and ultimately river and ocean. And this is just the man-made debris. Naturally debris such as leaves and twigs are also commonly found in streets and gutters, and then make their way into the storm drain system when it rains, or when water from some other source makes its way into the street.

It is not just the introduction of these items into the drain system that is a problem. Most storm drain systems ultimately empty directly into a nearly body of water, often a river or the ocean. Also, the systems rarely include any type of intermediate water treatment facility, so what goes into the drain system usually ends up in river, lake or ocean, where it is unsightly and can be toxic.

Because the introduction of trash and other debris into the storm drain system is such a common occurrence, many street side drains are constructed with a sizeable open chamber into which the storm drain opening leads, with the conduit to the under-street pipe located at one end thereof. The purpose of this is to try to trap as much of the debris as possible in the vault, and only allow the water to run-off into the system. This has proven only partially effective. First, so much trash is often introduced into the vault that much of it gets into the system anyway. This is particularly true if there is an accumulation of trash in the vault when there is a heavy rainfall or other heavy flow of water into the vault. Second, this arrangement necessarily requires that the vault be periodically cleaned, and cleaning the vault cannot of course be done by the usual street sweeping equipment, but requires an entirely different piece of equipment with strong suction capability to literally vacuum the trash from the vault. Third, this arrangement is designed to allow the trash to accumulate in the vault in between cleanings, such that in a worst case scenario, the accumulated trash becomes so large that the drain becomes plugged wholly or partially, and flooding in the area occurs when it rains.

In light of these issues, various attempts have been made to prevent trash from getting into drain. For example, in some places, a sizeable plate has been securely attached over the drain opening, leaving only a little space for water to flow. This solution does prevent much of the trash from entering into the drain, but it also prevents much of the water as well, and essentially defeats the purpose of the large drain opening that was intended to prevent flooding during heavy water run off. Therefore, other attempts have been made to design a storm drain gate that would remain closed during periods of low water run off, but which would automatically open in periods of heavy water run off. One recent example is U.S. Pat. No. 6,972,088, to Yehuda, in which a Pivotal Gate For A Catch Basin Of A Storm Drain System is disclosed. That system uses a rather complex system involving a rotatable paddle wheel and interconnected wires that interplay to open the gate when sufficient water begins to flow into the drain. While it appears workable, this system may not be desirable for widespread installation given its complexity, which translates into higher initial cost and higher cost of upkeep. It is a given in any piece of machinery that the more moving and complex the component parts, the more costly to manufacture and install, and the more costly to maintain, and more likely to malfunction. Other prior art devices suffer from one or more of these drawbacks, as the design goals of simplicity, ease of installation, durability, low maintenance, and high effectiveness are difficult to achieve.

Therefore, there exists a need in the art for such a simple, effective gate system.

SUMMARY OF THE INVENTION

The invention herein depicted and describes provides such a device wherein the gate portion of the system that prevents trash from entering into the vault or drain basin is kept in the closed position by virtue of a trip plate that is rotatably attached to the back of the gate. The trip plate is attached to back lower portion of the gate, and is biased (in the preferred embodiment by a spring) to an "up" position (that is, substantially perpendicular in the preferred embodiment) relative to the gate. The trip plate is prevented from moving backward (that is, away from the gate), which in the preferred embodiment is accomplished by two pins extending from the plate into a groove formed in each of a pair of brackets that are attached to the drain basin wall. Thus, when there is no-flow or low-flow of water through the gate onto the trip plate, the plate stays in position and in turn keeps the gate in a close position, flush against the drain basin opening. When the flow of water increases to a predetermined point, however, the water weight on the trip plate increases to the point where the upward biasing is overcome, and the trip plate rotates downward. This releases the gate and allows it to open. When the water flow onto the trip gate stops or reduces to a sufficiently low flow, the water weight on the trip plate is no longer sufficient to overcome the upward biasing on the plate, and it rotates back into its "up" position, which in turn causes the gate to rotate downward into its "closed" position against the drain basis opening.

The preferred embodiment of this invention will now be depicted and described. As will be apparent to those skilled in the art, however, there are many different ways of attaching the various components of this system to the basin, and to one another, and of creating the biasing of the trip plate, and there are too many different ways to do so to list and describe here. Such common variants, even if not specifically described, are nonetheless considered to be within the scope of this invention.

DESCRIPTION OF THE PREFERRED EMBODIMENTS

Figure 1:
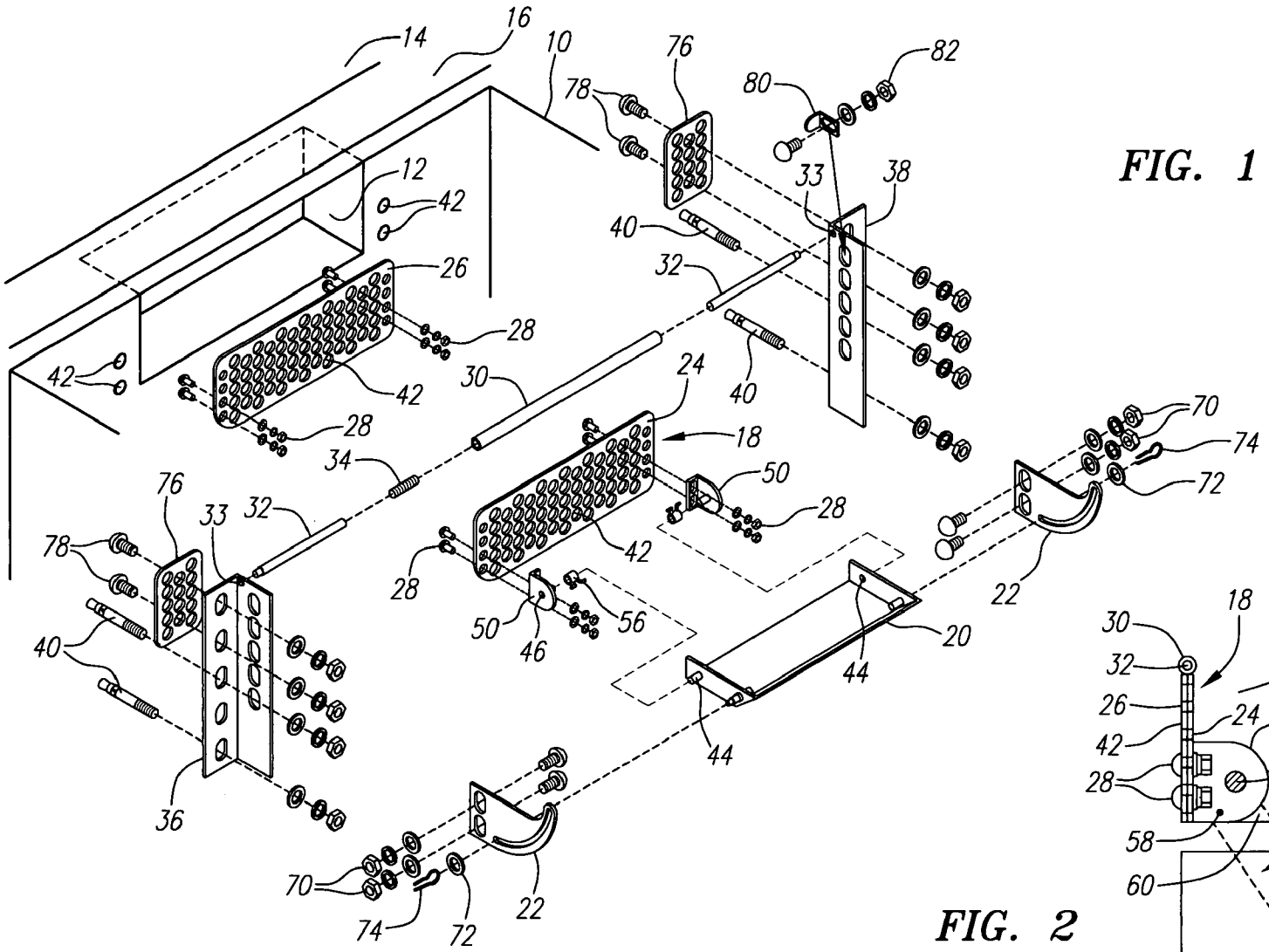
FIG. 1 is an exploded, perspective view of one embodiment of this invention.

Looking at FIG. 1, it is seen that the preferred embodiment of this invention is for attachment to the inside of a curb-side storm drain basin 10, adjacent to and providing a cover for the opening 12 that leads from the basin 10 to the street 14 through the curb 16. It should be noted, however, that while the device of this invention is believed to find primary utility in this application, and is why the title of this invention includes a reference to a storm drain, the invention herein described and claimed is a gate system that is not limited to that one application. The device of this invention could be usefully applied to any situation where it is desired to screen particulate matter from a fluid flow through an aperture during no-flow and low-flow conditions, but to remove the screen from the aperture during high-flow conditions.

The overall system consists primarily of a gate assembly 18, the biased trip plate 20, trip plate brackets 22, and the various means by which these components are attached to one another, and to the side of the basin 10. All components of this system are preferably constructed of 304 stainless steel. Other materials, however, could be used so long as they exhibited the required a strength and durability appropriate for the application in which the system is used.

Figure 2:
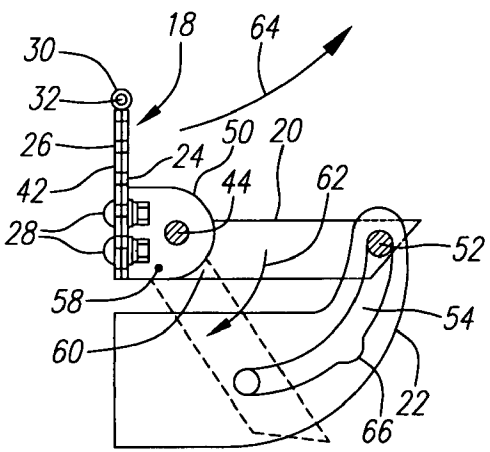
FIG. 2 is a partial side view of the preferred embodiment of this invention, showing the interplay between the gate, the trip plate and the guide brackets.

Although FIG. 1 shows in an exploded, perspective view how all of the various components are connected, the interplay of the gate assembly 18, the biased trip plate 20 and the trip plate guide brackets 22 can best be seen in FIG. 2. The gate assembly 18 comprises in this embodiment a pair of gate plates 24 and 26 that are held together by any conventional means, in this instance by nuts and bolts 28. Of course, there are a myriad of other ways to attach the two gate plates together, such as welding, gluing, screws, rivets, brackets, etc. Also, the gate assembly 18 does not have to be constructed of multiple plates, and could be of unitary construction, or could be of many individual plates.

In this embodiment, the gate plate assembly 18 is rotatably attached to the basin 10 by means of a hollow tube 30 that is attached to the top of the gate assembly 18, a pair of side pins 32 that are slidably housed within either end of the tube 30 and which are biased outwardly of the tube 30 by means of a spring 34 that is also housed within the tube 30 and forces the pins 32 outwardly. The distal end of the pins 32 engage appropriately-sized holes 33 in the large side brackets 36 and 38 (seen in FIG. 1, not shown in FIG. 2), which are in turn attached to the side of the basin 10 by conventional means—in this instance, by bolts 40 that are set into appropriated-sized holes 42 the side wall of the basin 10 on either side of the opening 10. As will be appreciated, this arrangement allows for easy attachment and free rotatability of the gate assembly 18 to the large side brackets 36 and 38, as one of the pins 32 can be placed into one of the holes 33, and then the other pin 32 can be pushed inwardly, the tube 30 brought into alignment with the other hole 33, and that pin 32 then allowed to extend into that hole 33 so that the entire gate assembly 18 is now firmly yet rotatably attached into position against the opening 12. As will be apparent, the attachment inter-relationship between these components can be adjusted to ensure that the gate 18 is properly positioned flushly against the opening 12.

To provide the desired screening function, the gate plates 24 and 26 have a number of holes 42 extending therethrough. These holes can be of any desired shape, size, configuration and distribution as desired under the circumstances. For example and not in way of limitation, commercial mesh screens could be used under the appropriate circumstances.

Referring now back to FIG. 2, it will be seen that the trip plate 20 is rotatably attached to the lower end of the gate assembly 18. Here, the attachment means provided are a pair of pins 44 attached to the side of the trip plate 20 and which communicate with appropriately sized holes 46 in small brackets 50 that are attached to the gate assembly 18 via the same nuts and bolts 28 that are used to attached gates plates 24 and 26 together. It will be appreciated, however, that the manner in which the trip plate 20 is attached to the gate assembly 18 is not limited to the means showed, and can be accomplished by any other conventional method and means whereby the trip plate 20 is securely but rotatably attached such that the trip plate 20 can rotate from a first or "up" position as shown in FIG. 2, downwardly to a second or "down" position, as shown in shadow in FIG. 2.

Again looking at FIG. 2, the interaction between gate assembly 18, the trip plate 20 and the side brackets 22 can best be appreciated. At the distal end of the trip plate 20, a pair of outwardly extending pins 52 communicate with an arcuate groove 54 formed in each of the brackets 22. In a no-flow or low-flow situation in which no or very little water is entering into the storm drain through the gate assembly 18, the trip plate 20 is biased upwardly so that the pins 52 are pressed against the top of the grooves 54. In this embodiment, the biasing of the trip plate 20 upwardly is accomplished by a pair of torsion springs 56 (seen only in FIG. 1). One end of the torsion springs resides in hole 58 in the side bracket 50 and the other end of the torsion spring resides in the hole 60 in the trip plate 20. Again, this is only one of many ways in which the trip plate 20 can be biased in an upward direction, and this invention is not limited to the one method and means shown.

The side brackets 22, the grooves 54 and the side pins 52 are all arranged such that in that position, the trip plate 20 extends in a horizontal fashion directly behind and perpendicular to the gate plates 24 and 26 on the gate assembly 18. Thus, in this position, the interplay between pins 52 within the bracket grooves 54, and the brackets 22 (which are attached to the side wall of the basin 10) has the effect of holding the gate assembly 18 in a vertical, "closed" position, flushly against the opening 12 in the drain basin 10.

The trip plate 20 will hold the gate assembly 18 in that position for so long as the water flowing through the basin opening 12 and onto the trip plate 20 is sufficiently small that the weight of the water bearing down on trip plate 20 is insufficient to overcome the upward biasing on the trip plate 20 caused by the torsion springs 56. As the flow of water increases, however, and the resultant gravitational water weight acting on trip plate 20 increases, the upward biasing is overcome, and the trip plate 20 begins to rotate in a downward direction, shown by arrow 62. As this occurs, the trip plate 20 moves out of its horizontal, perpendicular alignment relative to the gate assembly 18, which in turn allows the gate assembly 18 to begin to rotate in an upward direction as shown by arrow 64, effectively enlarging the open space to allow more water to flow into the basin. It will also be noted that as the trip plate 20 rotates downwardly, the side pins 52 travel downwardly within the grooves 54. In one embodiment of this invention, the grooves 54 are provided with one or more detents 66 (only one of which is shown in FIG. 2) which act as intermediately stopping points during the downward movement of the trip plate 20. In other words, as the water flow onto the trip plate 20 increases and its starts to rotate downward, it will encounter one of the detents 66. The pins 52 are forced into the detent, and will tend to reside there until the water weight increases incrementally until the pins 52 are forced out of the detents 66. This will allow for staged opening of the gate assembly 18, and will also work to prevent fluttering of the gate assembly as the water flow ebbs and increases. It will be appreciated that the size and depth of the detents 66 must be controlled so as to not unduly hinder the movement of the trip plate in either the downward or upward direction.

As the water weight continues to increase, eventually the biasing and the detents are overcome, and the trip plate 20 will rotate entirely downward (as shown in shadow in FIG. 2). At this point, the trip plate 20 ceases to exercise any limiting function on the gate assembly 18, which in turn is allowed to rotate entirely open. By appropriate sizing and placement of the brackets 50, the side pins 44 and the other components, the gate assembly 18 can be allowed to rotate through a full 90 degrees such that it comes to rest against the ceiling of the drain basis, in which case the storm drain opening 12 is complete unobstructed, maximum flow of water into the basis is allowed, and even trip plate 20 is pulled up substantially away from the water flow.

Once the water flow recedes, the upward biasing on the trip plate 20 will again be greater than the water weight acting on the trip plate, and it will again rotate upwardly, simultaneously forcing the gate assembly 18 downward and into its closed position flush against the basin opening 12.

Referring back to FIG. 1, it will been seen that the trip plate brackets 22 are attached to the large side brackets 36 and 38 by nut and bolts 70. to provide added stability to the interplay between the trip plate pins 52 and the grooves 54, the ends of the pins 52 can be fitted with washers 72 and screws 74 to ensure that the pins 52 remain within the grooves 54 at all times, even if the trip plate 20 happens to be subjected to an uneven, torquing force that might otherwise cause the pins to become dislodges from the grooves. Lastly, the overall system can include side plates 76 that are attached to the large side brackets 36 and 38 by conventional nut and bolts 78 and a simple flanged element 80 that is attached to the side bracket 38 by conventional nut and bolt 82, and which acts as a "stop" to prevent the gate assembly 18 from being pulled open in the direction of the street.

Although preferred embodiments have been shown and described, the disclosed invention and the protection afforded by this patent are not limited thereto, but are of the full scope of the following claims, and equivalents thereto.

The invention claimed is:

1. A gate system for attachment to a structure that has an opening through which fluid flows, the system comprising:

a) a gate assembly designed and constructed to allow fluid flow therethrough while preventing the passage of particulate matter of a predetermined size and shape, said gate assembly rotatably attached to said structure such that it can rotate between a closed position and an open position relative to said opening;

b) a trip plate rotatably attached to said gate assembly such that fluid flow through said gate assembly, at least in part, flows onto said trip plate, said trip plate being biased in an upward direction to a position that is substantially perpendicular to said gate assembly, and capable or rotational movement therefrom in a downward direction;

c) said trip plate having at least one pin extending from either side of the plate that communicates with an arcuate groove formed in a bracket attached to the structure that prevents movement of the trip plate in a direction perpendicularly away from said gate assembly; but does allow movement of said trip plate in a rotationally downward direction, such that when the fluid flow onto said trip plate overcomes the upward biasing, the trip plate is caused to rotate downward, in turn allowing said gate assembly to rotate from said closed position to said open position.

2. The gate system of claim 1 wherein said gate system is designed and constructed for attachment to the area within a curbside storm drain basin, adjacent the inside area of the opening thereto.

3. The gate system of claim 2 wherein said arcuate groove in said bracket has one or more detents that accept and restrain said downward movement of said at least one pin.

4. The gate system of claim 1 wherein said at least one pin extends from the distal end of said trip plate.

5. The gate system of claim 1 wherein said trip plate is biased in an upward direction by means of a spring that is attached at one end to said trip plate and at its other end to said gate assembly.

* * * * *